US006045144A

United States Patent [19]

Wong

[11] Patent Number: 6,045,144

[45] Date of Patent: Apr. 4, 2000

[54] ADJUSTABLE ROLLER SKATE

[76] Inventor: Jack Wong, Suit 702, 7th Fl., No. 43, Nung An Street, Taipei, Taiwan

[21] Appl. No.: 09/217,285

[22] Filed: Dec. 19, 1998

[51] Int. Cl.[7] ..... A63C 17/00

[52] U.S. Cl. ..... 280/11.26; 36/97; 36/115; 280/11.22

[58] Field of Search ..... 280/11.16, 11.22, 280/11.26, 11.27, 11.28, 633; 36/97, 115

[56] References Cited

U.S. PATENT DOCUMENTS

| | | | |
|---|---|---|---|
| 4,684,140 | 8/1987 | Olivieri | 280/11.26 |
| 4,708,352 | 11/1987 | Vallierme | 280/11.26 |
| 4,773,886 | 9/1988 | Teeter et al. | 280/11.3 X |
| 5,184,834 | 2/1993 | Yu | 280/11.16 X |
| 5,421,596 | 6/1995 | Lee | 280/11.19 |
| 5,484,149 | 1/1996 | Lee | 280/11.26 |

*Primary Examiner*—Michael Mar

[57] ABSTRACT

A roller skate of adjustable size includes an upper shoe portion and a lower frame portion. The upper shoe portion has a toe portion and a heel portion. The toe portion has a pair of studs received by a pair of slots formed on the heel portion. When the toe portion is assembled and affixed to the lower frame portion, the heel portion is also movably mounted in between. A buckling structure installed in a passageway formed in the lower frame portion is used to fix or release the movable heal portion. A spring is used to push up a buckling block in the buckling structure to fix the heel portion. An adjustment device is used to pull down the sprig for releasing the buckling block and, hence, the heel portion for easily adjusting the roller skate size. Similar ridged structures are formed on the buckling block and the heel portion to tightly couple each other. A shoe liner that includes an extendible section is also provided in the upper shoe portion to accommodate the change of the roller skate size.

14 Claims, 8 Drawing Sheets

ADJUSTABLE ROLLER SKATE

FIELD OF THE INVENTION

The present invention relates to a roller skate of adjustable size, and especially to a roller skate whose size can be adjusted manually without using any tool.

BACKGROUND OF THE INVENTION

A roller skate generally includes a plurality of wheels carried and supported by a lower frame portion attached to a roller skate upper shoe or boot. The upper shoe portion provides the support for a skater's foot while the lower frame portion provides the rigid substructure or undercarriage for the roller skate's wheels. Roller skates are very maneuverable and capable of moving at a higher speed as compared to conventional skates.

In prior art design, the conventional upper shoe portion of a roller skate is usually made of rigid, non-ventilating, and plastic material with an inner liner. The plastic material provides the rigid outer structure of the upper shoe portion and the soft inner liner made of sponge rubber or other sir Dial offers some comfort to the user. To ensure lateral stability, conventional alpine ski-boot designs have readily been adapted to roller skates. These boots provide support and durability necessary for roller skates.

However, the above prior art has an important drawback in that, generally, the size of the roller skate is fixed. Many users of the roller skate are children whose feet grow rapidly with their ages. A suitable size for a child of, for example) ten years old will become probably too small when the child tuns into eleven years old. Because roller skates are quite expensive, the cost of them may be a significant burden to parents. Although some of the skates are manufactured with adjustable size, the adjustable braces and supports for accommodating numerous shoe sizes and shapes are usually bulky and uncomfortable. There is a strong demand for a roller skate which is comfortable to wear and whose size is easy to adjust

SUMMARY OF THE INVENTION

The present invention has been made to overcome the above-mentioned drawbacks of a conventional roller skate. The primary object of the present invention is to provide a roller skate whose size can be adjusted without using any tool. The roller skate of this invention comprises an upper shoe portion and a lower frame portion. The upper shoe portion includes a heel portion that is movable for easily adjusting the size of the roller skate.

According to the present invention, the upper shoe portion comprises a toe portion and a heel portion. The rear end of the toe portion includes a pair of studs that are received by two slots formed on the heel portion. When the toe portion is assembled and affixed to the lower frame portion, the heel portion is also movably mounted thereon. By moving the heel portion forward or backward, the size of the roller skate can be adjusted to accommodate different users.

Another object of the invention is to provide a mechanism for easily adjusting the size of the roller skate. According to this invention, a buckling structure for fixing or releasing the heel portion is installed in a passageway formed in the lower frame portion of the roller skate. The buckling structure includes a buckling block that has a number of ridge members for tightly coupling to a plurality of ridge members formed on the heel portion. A spring is used to push the buckling block up against and fix the heel portion. The buckling structure further has a pair of adjustment devices that can be used to pull down the spring and release the buckling block to allow free movement of the heel portion for adjusting the size of the roller skate.

In the present invention, the upper shoe portion has a shoe liner to offer more comfort to a user. It is also an object of the invention to provide an extendible shoe liner to accommodate the size change of a roller skate. Accordingly, the shoe liner of this invention comprises a toe liner, a heel liner and an extendible liner connecting the toe liner and the heel liner. The extendible liner is made of an elastic material that can be extended or compressed to fit the size of the roller skate.

The various objects and advantages of the present invention will be more readily understood from the following detailed description when read in conjunction with the appended drawing.

DETAILED DESCRIPTION OF THE PREFERRED EMBODIMENTS

Figure 1:
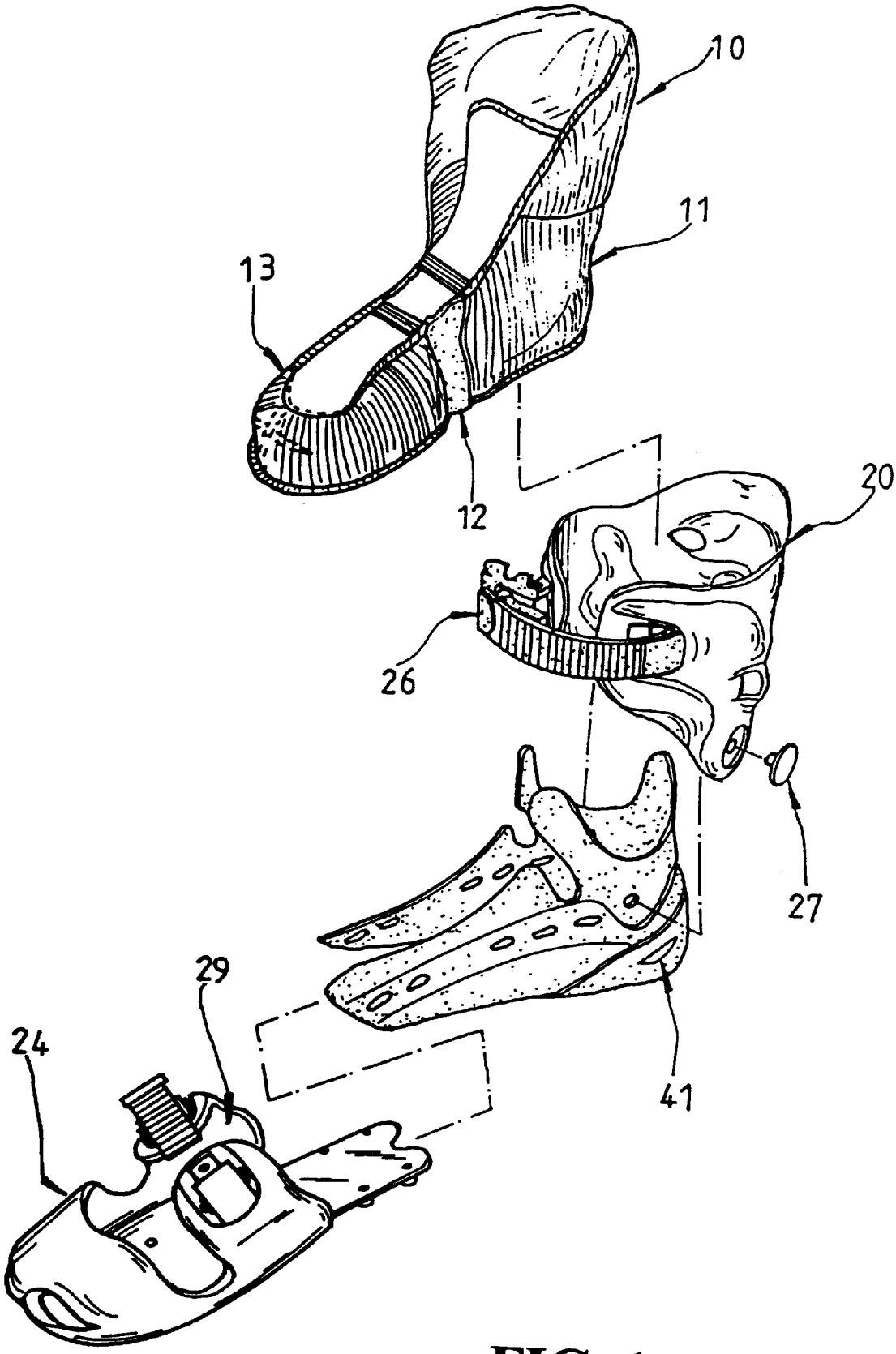
FIG. 1 is an exploded perspective view of a roller skate of the present invention.
Figure 3:
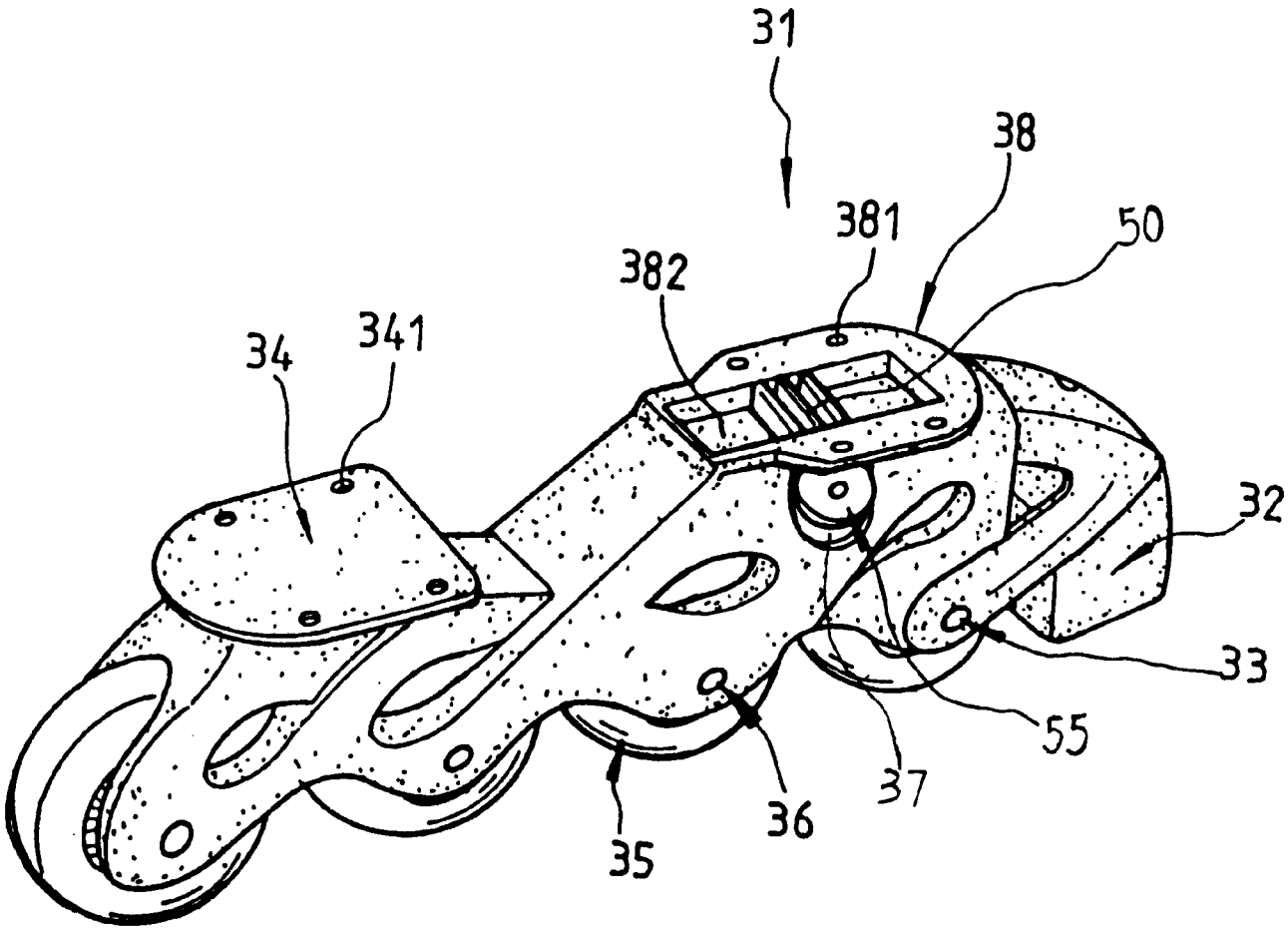
FIG. 3 illustrates a perspective view of a lower frame portion of the in-line roller skate according to the present invention.

With reference now to FIGS. 1 and 3, an in-line roller skate of the present invention is disclosed. The in-line roller skate includes a shoe liner 10, an ankle supporting portion 20 having a conventional securing strap 26, a toe portion 24, a heel portion 41, and a lower frame portion 31.

The ankle supporting portion 20 is hingedly mounted on the heel portion 41. In general, the ankle supporting portion is made of either rigid or semi-rigid material. It also includes a fastening means 27 for fixing the ankle supporting portion 20 to the heel portion 41. The toe portion 24 includes a lace portion 29 that covers the front end of a user's foot. The heel portion 41 is movable relative to the toe portion 24.

Figure 2:
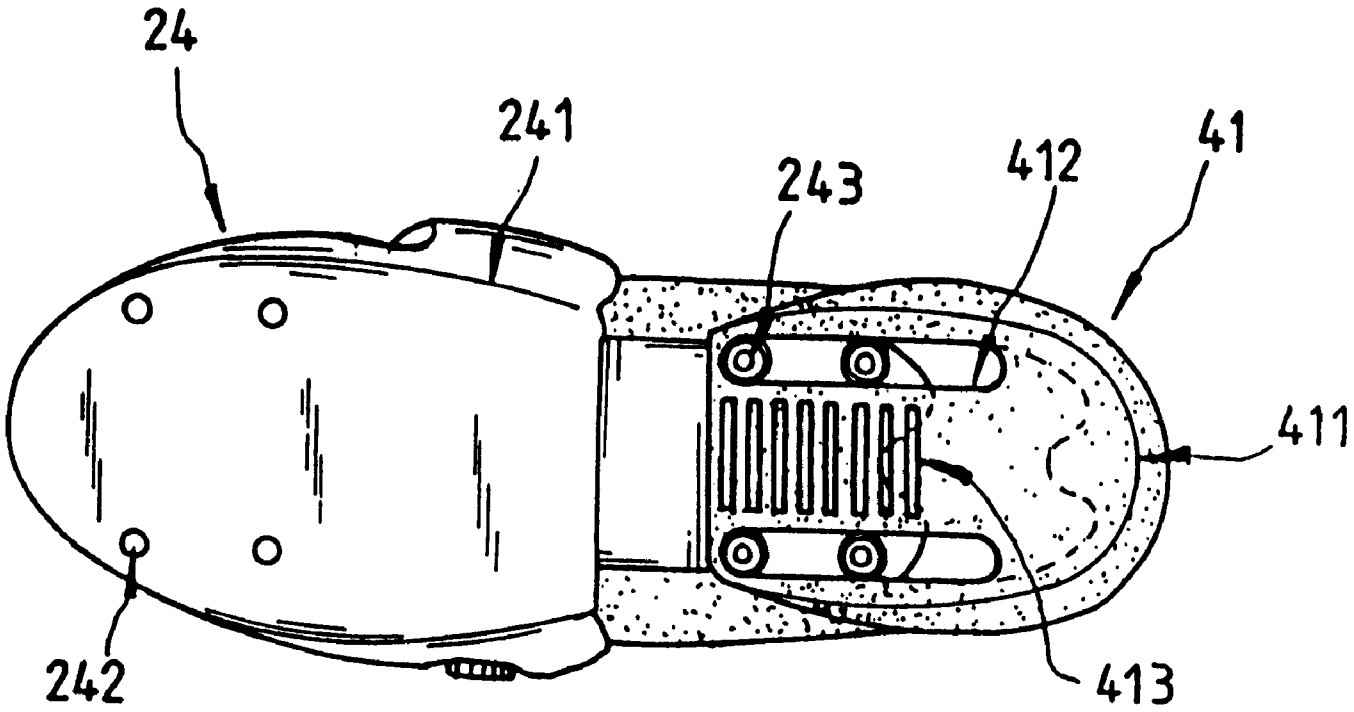
FIG. 2 illustrates the sole of the roller skate made in accordance with the present invention.

Accordingly, the toe portion 24 and the heel portion 41 form the base portion. The heel portion 41 is attached to the ankle supporting portion 20. The materials for manufacturing the heel portion 41 and the toe portion 24 are rigid materials such as heat moldable plastics or metals. With reference to FIGS. 1 and 2, the heel portion 41 has a proper size to accommodate the toe portion 24 as well as the ankle supporting portion 20.

FIG. 2 illustrates the sole of the in-line roller skate made in accordance with the present invention. It may be a relatively simple flat sole or a relatively complex contoured sole containing supports and attachment means. For the purpose of the present disclosure, the sole will be described according to FIG. 2. It is understood that not all of the supports or attachments described hereinafter need to be included in every embodiment of the present invention.

The sole of the in-line roller skate is formed by a toe sole portion 241 and a heel sole portion 411. The toe sole portion 241 has two pairs of screw holes 242 and two pairs of studs 243 formed along parallel lines. The heel sole portion 411 comprises two slots 412 which are aligned in parallel with the lines formed by the studs 243 and a plurality of ridge members 413 transversely extending between the two slots 412 and longitudinally spaced along the bottom of the heel sole portion. The sole of the in-line roller skate provides an interface for mounting the lower frame portion 31 (shown in FIG. 3) that is manufactured as a separate unit.

Illustrated in FIG. 3 is the lower frame portion 31 of the in-line roller skate of the present invention which is typically formed of injection molded plastic or metal. It may alternatively be made of fiberglass with an epoxy resin or graphite with an epoxy resin. A plurality of in-line roller skate wheels 35 are mounted on the axle means 36. The in-line roller skate wheels 35 can be rotated in a common longitudinal plane. It is understood that a variety of methods for mounting the in-line roller skate wheels 35 can be used, including a mounting method that allows variation in the vertical position of the axes of rotation.

A bumper 32 is affixed to the rear end of the lower are portion 31. The bumper 32 is used as a speed controller of the in-line roller skate. The material thereof may be the same as or different from that of the lower frame portion 31. As can be seen from FIG. 3, the lower frame portion 31 is formed as an integral that has a frame end having a substantially flat top surface 34. Four screw holes 341 whose positions are aligned with the screw holes 242 of the toe sole portion 241 are formed on the front flat top surface 34.

Figure 4:
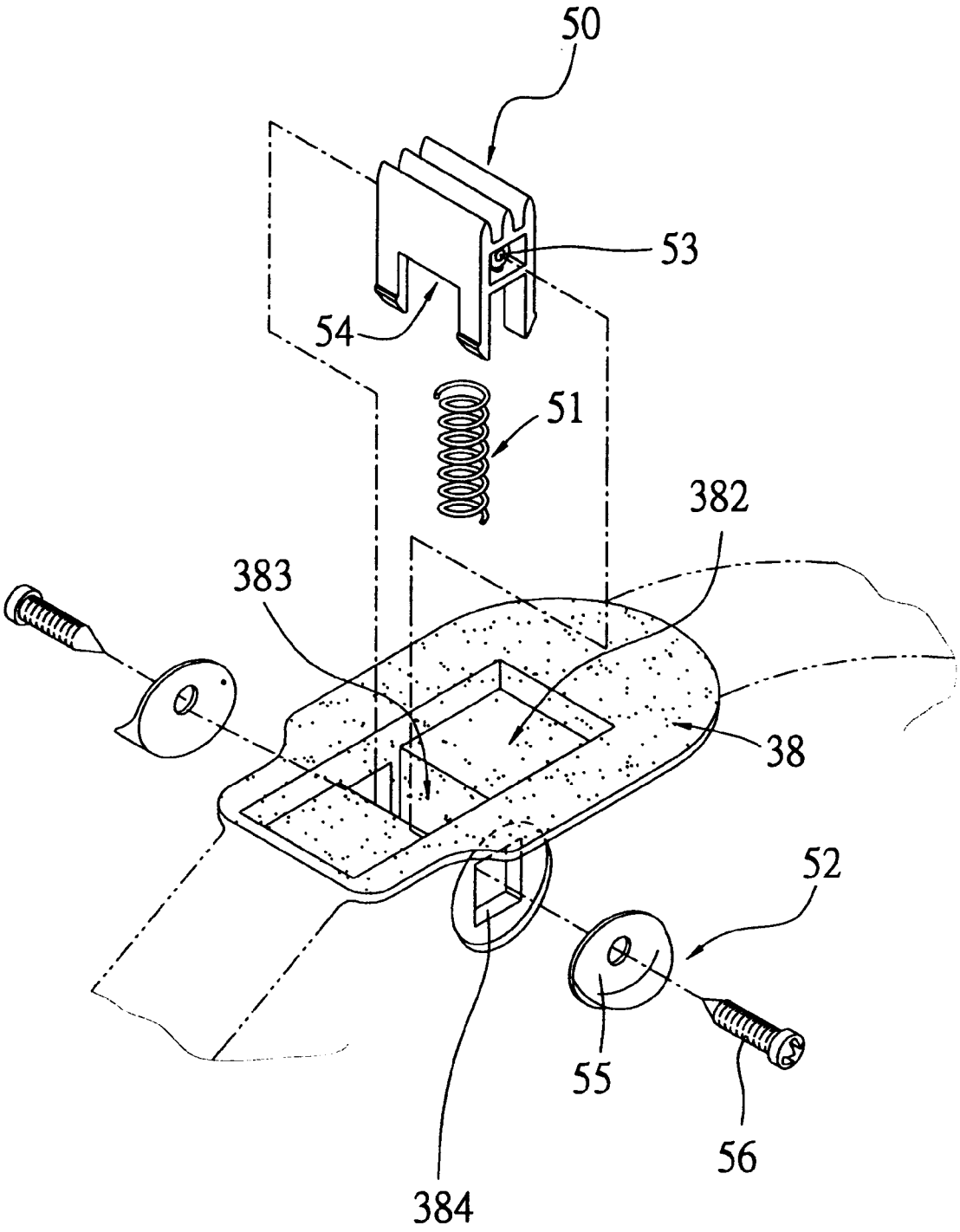
FIG. 4 illustrates a decomposed view of the buckling structure of the present invention.

Referring to FIG. 3, the rear end of the lower frame portion 31 has a substantially flat top surface 38 with a recessed area 382. The rear flat top surface 38 has two pairs of screw holes 381 on the two sides. The positions of the screw holes are aligned with the positions of studs 243 on the toe sole portion 241. The recessed area 382, which aces the ridge members 413 on the heel sole portion 411, is formed in the central part of the rear flat top surface 38. A passageway 383 as shown in FIG. 4 is formed in the middle of the recessed area 382 with two openings 384 on the two sides of the passageway 383. As can be seen from FIGS. 3 and 4, each opening 384 is located in a side recessed portion 37 on the lower frame potion 31.

A spring 51 is mounted on the bottom portion of the passageway 383 to stand upright. As can be seen from FIGS. 3 and 4, a buckling structure is formed by a buckling block 50 which has ridge members on top to match with the ridge members 413 on the heel sole portion 411. The lower portion of the buckling block 50 is a hollow space 54. The buckling block 50 also has two side holes 53 aligned with openings 384. Furthermore, the buckling structure includes two adjustment devices 52 each comprising an adjustment button 55 and a screw 56.

With reference to FIG. 4, the buckling block 50 is positioned into the passageway 383 with the ridge members facing upwards and the spring 51 is inserted into the hollow space 54 so as to push up the buckling block 50. The screws 56 of the two adjustment devices 52 are fastened to the buckling block 50 through the holes of the adjustment buttons 55, the openings 384 and the side holes 53. The adjustment buttons 55 are received in the side recessed portions 37 as shown in FIG. 3. Because the side recessed portions 37 are larger than the adjustment buttons 55, the adjustment devices 52 can be moved up and down vertically within the side recessed portions 37. During the normal use of the roller skate, the buckling block 50 and the ridge members 413 of the heel sole portion 411 are tightly coupled together because the spring 51 pushes up the buckling block 50. If a user presses the adjustment devices 52 downwards, the buckling block 50 is pulled downwards. Therefore, the buckling block 50 is released and de-coupled from the ridge members 413.

Figure 5:
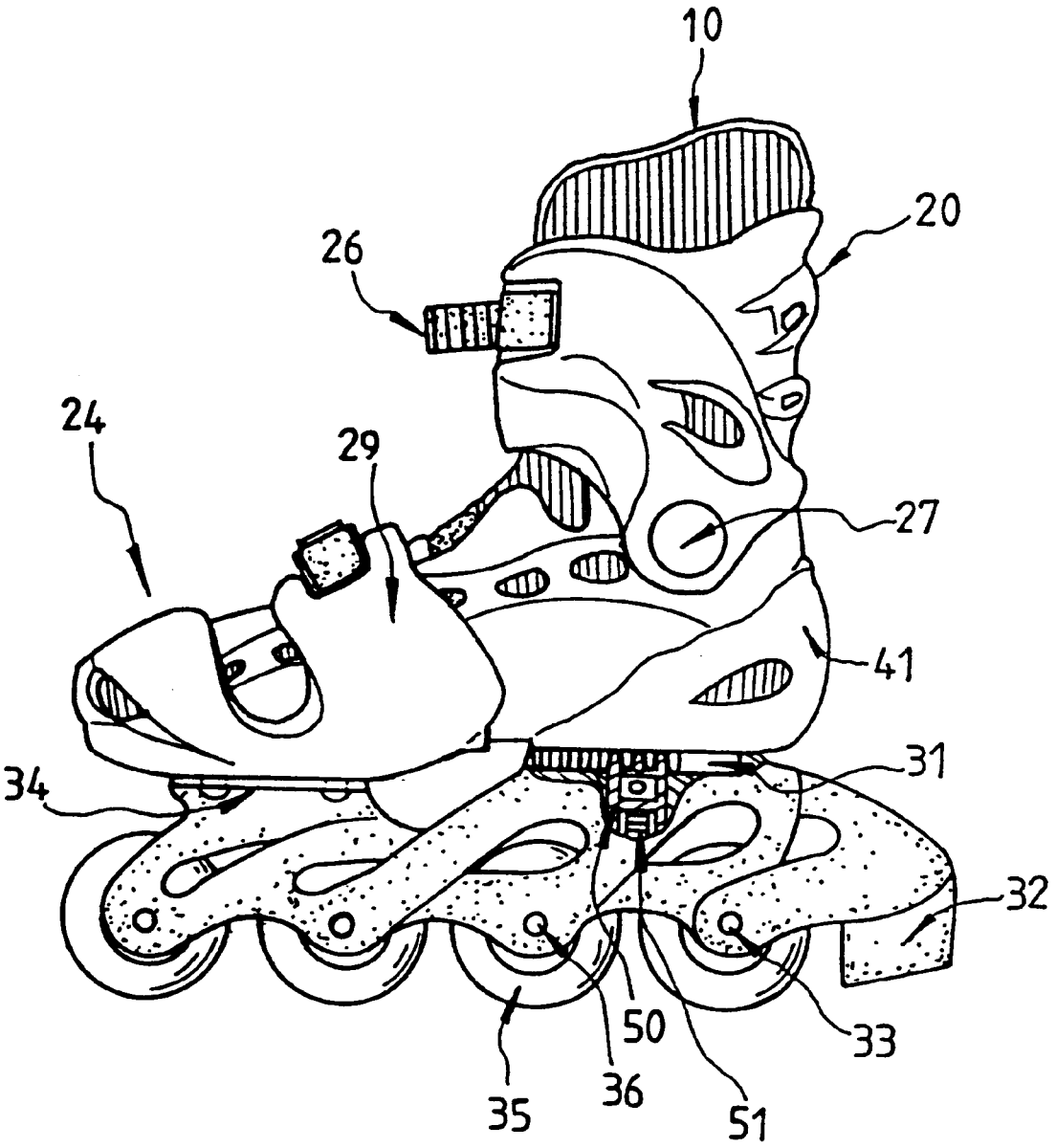
FIG. 5 shows the assembled in-line roller skate of the present invention.

The lower frame portion 31 and the toe portion 24 are assembled together by means of screws, the screw holes 341 on the front flat top surface 34 and the screw holes 242 of the toe sole portion 241. The heel portion 41 are movably attached to the lower frame portion 31 by inserting the studs 243 tough the slots 412 of the heel sole portion 411 and the screw holes 381 of the lower fame portion 31. The fastening means 27 fixes the ankle supporting portion 20 to the heel portion 41. The assembled structure is shown in FIG. 5 wherein the ridge members of the bucking block 50 is engaged with the ridge members 413 of the heel sole portion 411 so that the movable heel portion 41 is fixed by the engagement of the buckling block 50 and the ridge members 413.

If the size of the in-line roller skate of the present invention is not suitable for the feet of a user (too small or too large), the user can press the adjustment devices 52 downwards to pull the spring 51 downwards. Thus, the buckling block 50 is released from the ridge members 413 of the heel portion 41 so that the heel portion 41 is movable along the tracks of the two slots 412, Because the ankle supporting portion 20 is fixed to the heel portion 41, it is also moved along with the heel portion 41. If the size of the in-line roller skate is too small, the movable heel portion 41 can be pulled backwards to enlarge the skate size, and vice versa.

Figure 6:
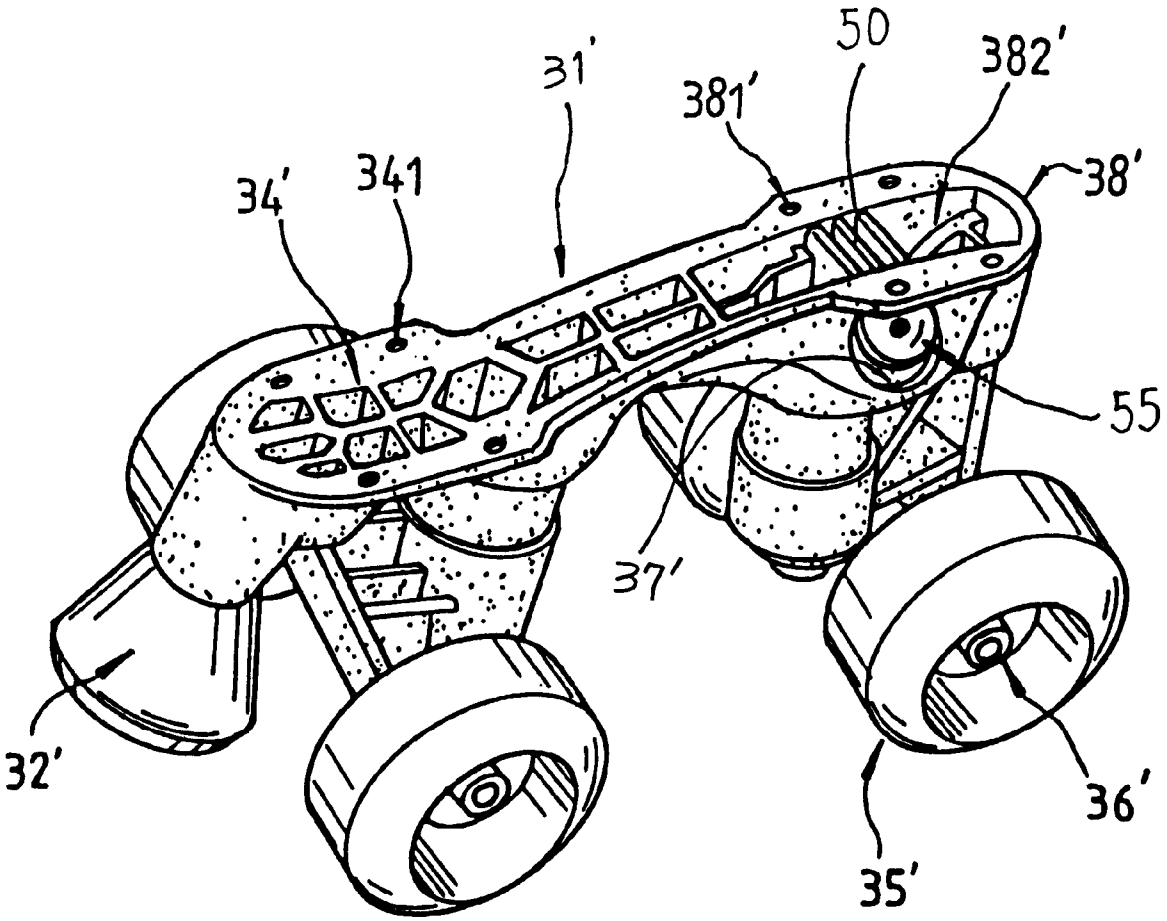
FIG. 6 illustrates a perspective view of a lower frame portion of a double-bank roller skate according to the present invention.

FIG. 6 shows another embodiment of the lower frame portion of the roller skate of the present invention. In this embodiment, an example of a double-bank roller skate is shown. The lower frame portion 31' is typically formed of injection molded plastic or metal. It may alternatively be made of fiberglass with an epoxy resin or graphite with an epoxy resin. A plurality of double-bank roller skate wheels 35' are mounted on the axle means 36'.

A bumper 32' used as a speed controller of the skate is affixed to the front end of the lower frame portion 31'. As can be seen from FIG. 6, the lower frame portion 31' is an integral formed with a substantially flat front top surface 34' that has four screw holes 341' whose positions are aligned with the screw holes 242 of the toe sole portion 241.

Referring to FIG. 6, the rear end of the lower frame portion 31' also has a substantially flat top surface 38'. The rear flat top surface 38' has two pairs of screw holes 381' on the two sides. The positions of the screw holes 381' are aligned with the positions of studs 243 on the toe sole portion 241. A recessed area 382', which is aligned with the ridge members 413 on the heel sole portion 411, is formed in the central part of the flat top surface 38'. A passageway is formed in the middle of the recessed area 382' with two openings located on the two side recessed portions 37' of the lower frame portion 31'.

Figure 7:
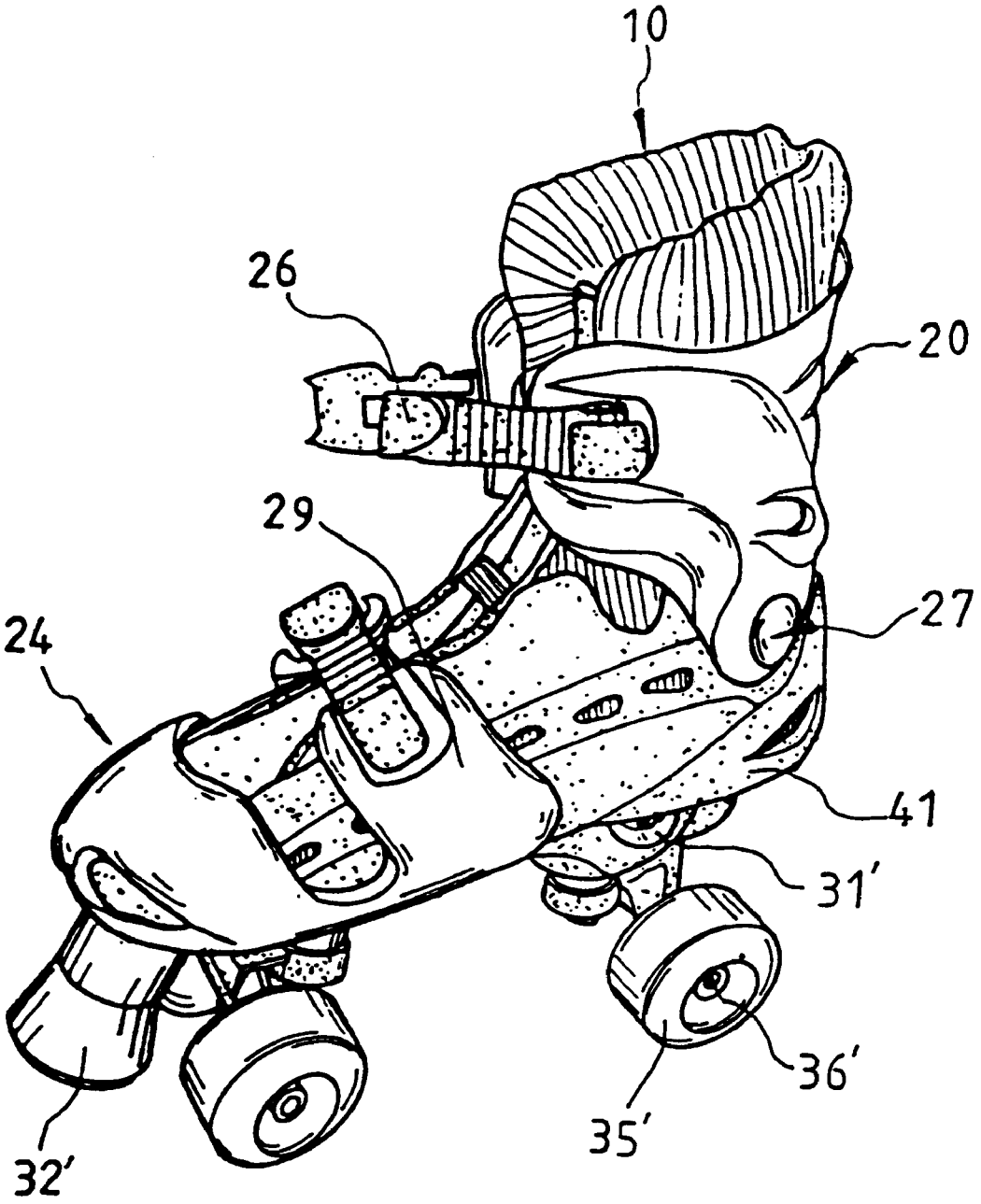
FIG. 7 shows the assembled double-bank roller skate of the present invention.
Figure 8:
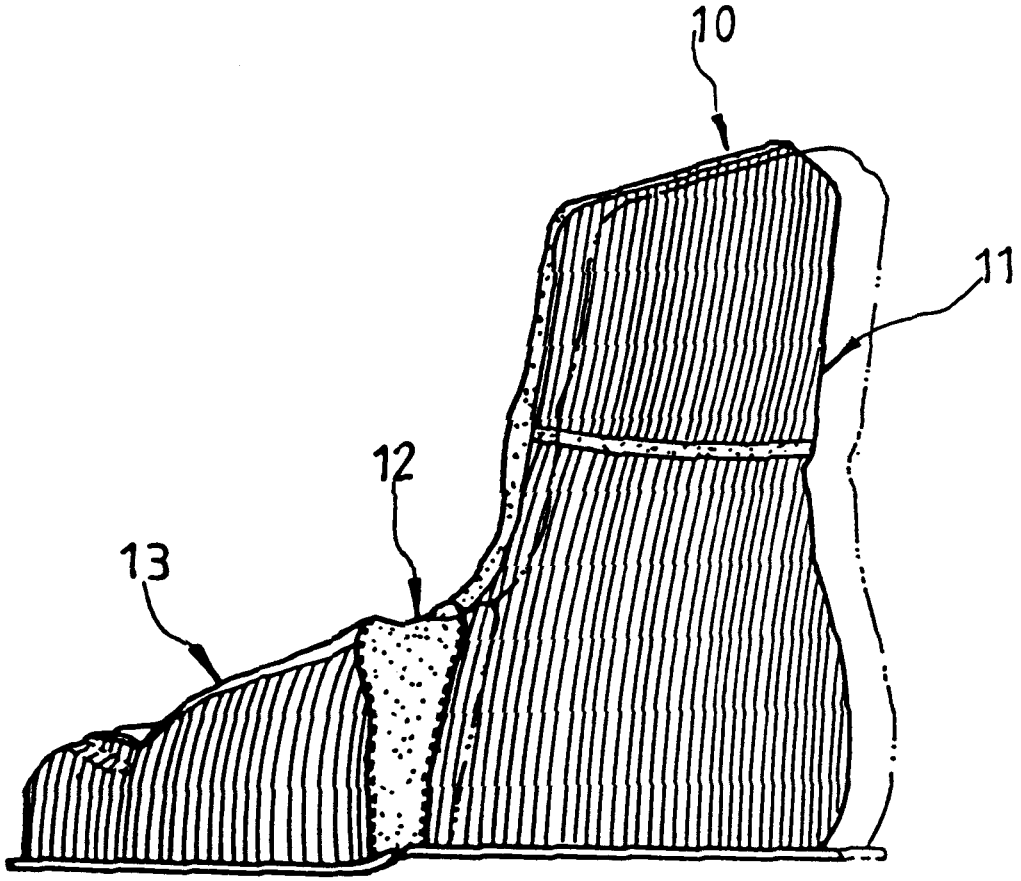
FIG. 8 is a side view of the shoe liner of the present invention.

A spring (not shown in FIG. 6) is mounted on the bottom portion of the passageway to stand upright. A buckling structure including two adjustment devices identical to those used in the first embodiment is also used for the double-bank roller skate. The buckling structure and the assembling manner of the double-bank roller skate are completely the same as that described in the embodiment of the in-line roller skate. The assembled view of the double-bank roller skate is shown in FIG. 7.

The side view of the shoe liner 10 of the present invention is shown in FIG. 1. It can be seen that the shoe liner 10 is formed by three portions, i.e., a heel liner 11, an extendible liner 12, and a toe liner 13. According to the present invention the extendible liner 12 is made of elastic materials. Therefore, the length of the liner of the roller skate may be expanded or compressed to accommodate the size change of the roller skate. From the above description, it is clear that the adjustment of the size of roller skate can be done manually without using any additional tool.

Although the present invention has been described with reference to the preferred embodiments, it win be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A roller skate comprising:

a lower frame portion including:

a front part having a substantially flat top surface;

a rear part having a substantially flat top surface with a top recessed portion, two side recessed portions and a passageway, said passageway having a top opening through said top recessed portion and two side openings through said two side recessed portion; and a plurality of skate wheels mounted thereon;

an upper shoe portion including:

a toe portion having a front end affixed to said flat top surface of the front part of said lower frame portion, and a rear end having two pairs of studs affixed to said flat top surface of the rear part of said lower frame portion; and a heel portion having two slots each being aligned with and receiving a pair of studs of said rear end of said toe portion, and a plurality of ridge members transversely extending between said two slots and longitudinally spaced along the bottom of said heel portion, said heel portion being movably mounted between said rear end of said toe portion and said lower frame portion, said ridge members facing said passageway of said lower frame portion;

and a buckling structure including:

a buckling block having a plurality of ridge members for coupling to said ridge members of said heel portion, ad a hollow bottom part;

an elastic element positioned in said passageway of said lower frame portion and extended through said top opening into said hollow bottom part for pushing said buckling block upwardly against said heel portion; and two adjustment devices each being received in one of said two side recessed portions and affixed to said buckling block through one of said two side openings, said side recessed portions being sufficiently larger than said adjustment devices for allowing said adjustment devices to be moved vertically relative thereto;

wherein said heel portion is movable relative to said toe portion for adjusting the size of said roller skate when said adjustment devices are pressed downwardly against said elastic element to de-couple said buckling block from said ridge members of said heel portion.

2. The roller skate as claimed in claim 1, wherein each of said adjustment devices comprises a screw and an adjustment button having a center hole, said screw passing through the center hole of said adjustment button and a side opening of said passageway of said lower frame portion to a side screw hole formed on said buckling block.

3. The roller skate as claimed in claim 1, wherein said roller skate is an in-line roller skate.

4. The roller skate as claimed in claim 1, wherein said roller skate is a double-bank roller skate.

5. The roller skate as claimed in claim 1, wherein said heel portion is made of heat moldable plastics or metals.

6. The roller skate as claimed in claim 1, wherein said toe portion is made of heat moldable plastics or metals.

7. The roller skate as claimed in claim 1, wherein said upper shoe portion further comprises a shoe liner, and an ankle supporting portion hingedly mounted on said heel portion.

8. The roller skate as claimed in claim 7, said shoe liner comprising a heel liner, a toe liner, and an extendible liner connecting said toe liner and said heel liner, said extendible liner being made of elastic materials.

9. The roller skate as claimed in claim 7, wherein said ankle supporting portion is made of either rigid or semi-rigid material.

10. The roller skate as claimed in claim 1, wherein a bumper used as a speed controller is adhered to said rear end or said front end of said lower frame portion.

11. The roller skate as claimed in claim 1, wherein said elastic element is a spring.

12. The roller skate as claimed in claim 1, wherein said lower frame portion is formed of injection molded plastic or metal.

13. The roller skate as claimed in claim 1, wherein said lower frame portion is made of fiberglass with an epoxy resin.

14. The roller skate as claimed in claim 1, wherein said lower frame portion is made of graphite with an epoxy resin.

* * * * *